United States Patent [19]

Calderon

[11] Patent Number: 4,895,999

[45] Date of Patent: Jan. 23, 1990

[54] PROTECTIVE SAFETY ENCLOSURE FOR ELECTRICAL OUTLETS

[76] Inventor: Bill R. Calderon, 1211 Ebener St., Redwood City, Calif. 94061

[21] Appl. No.: 245,586

[22] Filed: Sep. 19, 1988

[51] Int. Cl.[4] ..... H01R 13/447

[52] U.S. Cl. ..... 174/67; 220/242

[58] Field of Search ..... 174/67; 220/242; 439/135, 147

[56] References Cited

U.S. PATENT DOCUMENTS

| | | | |
|---|---|---|---|
| 3,067,402 | 12/1962 | Thaw | 174/67 X |
| 3,363,216 | 1/1968 | Benedetto | 174/67 X |
| 3,601,757 | 8/1971 | Gober | 439/147 |
| 4,067,360 | 2/1978 | Singh | 174/67 X |
| 4,083,618 | 4/1978 | Busch, Jr. | 439/147 |
| 4,605,817 | 8/1986 | Lopez | 174/67 |
| 4,662,697 | 5/1987 | Moses | 439/148 |
| 4,705,335 | 11/1987 | Goebel | 439/133 |
| 4,733,017 | 3/1988 | Wolfe-Taylor | 174/67 |

*Primary Examiner*—Leo P. Picard
*Assistant Examiner*—David A. Tone

[57] ABSTRACT

A protective safety enclosure for an electrical outlet assembly includes a basic three-dimensional hollow enclosure adapted to fit over an outlet assembly and provides an aperture in its front panel corresponding to each socket within said electrical outlet assembly to permit the passage of a plug and line cord so that a plug may be removably engaged with a socket in said assembly, and having a first removable covering shield to prevent access to an unused socket and second removable covering shield to enclose a plug engaged in a socket in said assembly and grip its line cord to prevent its inadvertent removal.

3 Claims, 2 Drawing Sheets

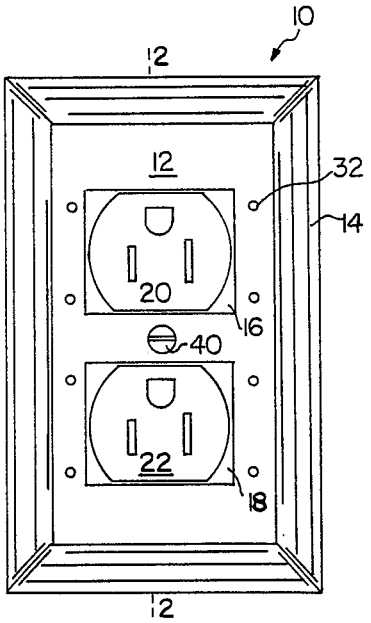
FIG.1
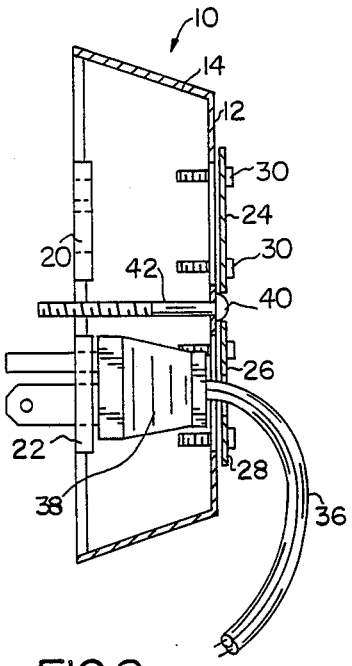
FIG.2
FIG.3
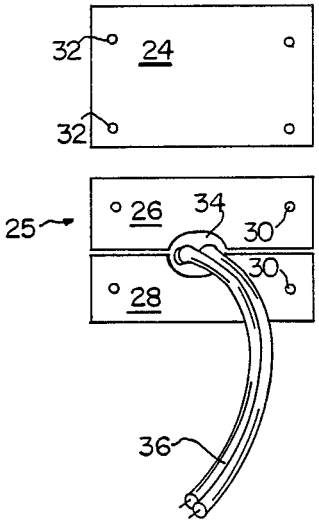
FIG.4
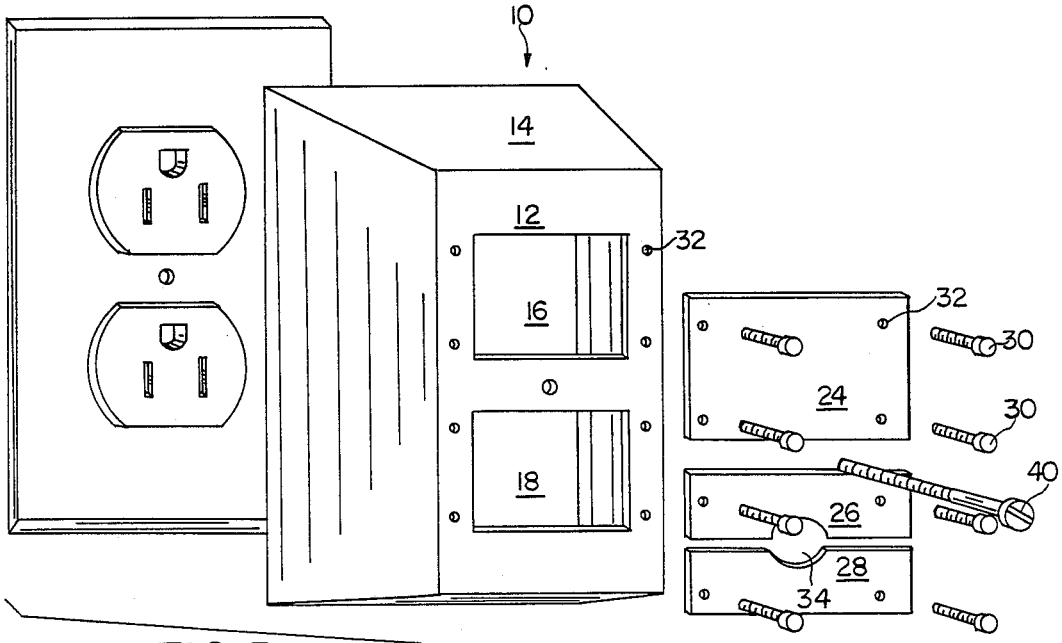
FIG.5

PROTECTIVE SAFETY ENCLOSURE FOR ELECTRICAL OUTLETS

BACKGROUND OF THE INVENTION

This invention pertains to the field of safety enclosures and/or covers for electrical outlet assemblies and specifically to protective devices designed to prevent or impede an infant or small child from touching an electrical outlet and/or inserting or removing a plug from an outlet.

Electrical shock is a major cause of accidental injury and death to small children. Most indoor areas frequented by children such as homes and schools have numerous electrical outlets within reach of even the smallest child. This dangerous condition is well known. Numerous prior art devices have been proposed or are commercially available which are directed to preventing a child from touching the sockets in an outlet assembly or preventing a child from inserting or removing an electrical plug in or from a socket. Despite the proliferation of proposed solutions, no such device or group of devices has achieved wide acceptance and the hazardous condition remains today. The reasons that prior art solutions to this problem have not gained public acceptance relate to ease of use, cost and effectiveness. A complex device which is cumbersome to use will not gain public acceptance regardless of its effectiveness or cost. With typical living quarters for families with children having thirty to one hundred outlets and a plurality of appliances being used frequently in an area with a limited number of outlets, such as a kitchen, ease of use and cost are important criteria for acceptance. A review of the commercially available products and prior patent art shows that the most effective devices are also the most costly, the most cumbersome to use and the least available commercially. The present invention is directed to a solution to this long standing serious problem.

Another serious limitation of prior art devices is that they are designed almost exclusively for the conventional duplex outlet. Today, arrays or banks of four to six sockets are common in outlet assemblies in kitchens, home entertainment rooms and home computer rooms. Arrays or banks of six to twelve sockets are common in home workshops.

The prior patent art is summarized in U.S. Pat. No. 4,605,817 which discloses a safety cover for electrical outlets including plug retention in the outlet. What the prior art fails to disclose is a simple, easily installed and economical enclosure which serves the dual protective goals of preventing a child from touching an electrical outlet either with a finger or with a conductive instrumentality and preventing a child from inserting or removing a plug in or from the outlet, while still permitting the frequent insertion and removal of plugs by adults. It also fails to disclose a design which is adaptable to electrical outlet assemblies having a wide range of shapes and a large number of sockets.

It is the principal object of the present invention to provide an inexpensive protective enclosure for an electrical outlet which is easily installed and removed, and which is easy to use for adults, but which is essentially inoperative by small children.

Another object is to provide a protective enclosure which is simple in construction, while providing a reasonably safe level of protection for children.

Yet another object is to provide a protective enclosure which has manually operable closure elements which require adult dexterity and are resistant to the tampering of children such that the probability of a child defeating the safety feature is extremely low.

It is further object of the invention to provide a protective enclosure which fits over standard electrical outlet assemblies, requiring no modification thereof, and which can remain in place whether or not the outlet is in use and whether the use is continuing or intermittent.

It is still a further object of the invention to provide a protective enclosure whose basic design and principle of operation is readily adaptable to electrical outlet assemblies having any number of sockets in one junction box or housing.

SUMMARY OF THE INVENTION

The present invention is a protective safety enclosure for an electrical outlet assembly. This enclosure is a three-dimensional, hollow box-like or shell-like structure having one major open face whose perimeter edges have contours substantially similar to the contours of the outlet assembly to be covered, has greater depth than a conventional cover plate so that a plug can be enclosed therein, and has a substantially flat front face or wall which is spatially distant from the front surface of the sockets in the outlet assembly. The perimeter wall or walls of the enclosure have a shape determined by the coutour of the outlet assembly. For a rectangular duplex outlet, the enclosure has the general shape of a five-sided box. For a cylindrical junction box, it has a hemispherical shape truncated to provide a flat front panel. The perimeter edges of the open face fit snugly around the perimeter of the outlet assembly or a cutout in a structural member receiving the electrical outlet assembly to be enclosed. The protective enclosure is secured to the electrical outlet assembly by one or more elongated screws or bolts utilizing the threaded holes provided for a conventional outlet plate in said assembly. The flat front panel of the protective enclosure has one aperture or opening for each socket within the enclosed electrical outlet assembly, each opening being similar in size and shape to the socket face and in registration therewith, but spaced apart therefrom. Each of said apertures has a plurality of small holes about its periphery to receive in a snap-fitting arrangement a small covering shield slightly larger than said aperture. For a socket which is not in use, said shield is a solid panel having tapered prongs about its periphery in registration with the small holes about the periphery of said aperture and adapted to be snap-fitted into said holes. The fit of this protective shield is sufficiently snug that a screw driver or knife is required to force it out. For a socket which is in use, the covering shield has a central aperture to permit the passage therethrough of a line cord connected at one end to a plug and this shield is divided into two equal parts or members such that the line cord aperture is bisected, one half of its aperture being cut out from each member. Each member is a half shield and has half the plurality of prongs of a full shield similarly situated. After a plug is inserted into a socket through the large aperture in the front panel, a first half shield is placed in position and the line cord is positioned in or near its small cut-out. The second half shield is then positioned on the front panel such that when it is snapped into place, the line cord is gripped snugly within the total aperture of the two half shields.

The snap-fit of the shields should be tight enough to prevent a plug from being removed by a child.

BRIEF DESCRIPTION OF THE DRAWINGS

FIG. 1 is a front plan view of a preferred embodiment of the protective enclosure of the present invention with the covering shields removed sized to fit a duplex electrical outlet assembly;

FIG. 2 is a cross-sectional view taken along the line 2—2 of FIG. 1 showing a plug, line cord, first covering shield and second covering shield in their operative positions;

FIG. 3 is a front plan view of a first covering shield for use with the enclosure of FIG. 1;

FIG. 4 is a front plan view of a second covering shield for use with the enclosure of FIG. 1;

FIG. 5 is an exploded perspective view of the enclosure of FIG. 1;

DESCRIPTION OF THE PREFERRED EMBODIMENTS

Figure 6:
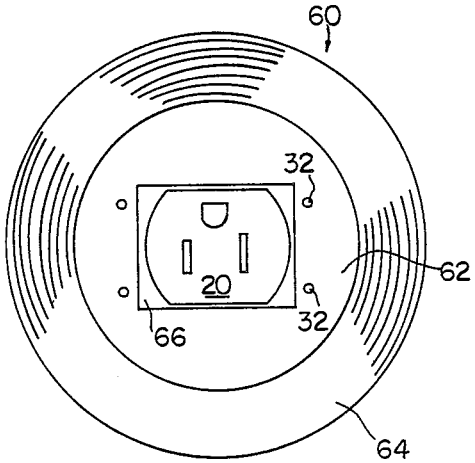
FIG. 6 is a front perspective view of a second embodiment of the enclosure of the present invention designed to cover an electrically outlet assembly with circular contours.

The typical electrical outlet assembly used in a home environment has from one to six female sockets or receptacles within a junction box and the junction box may have a variety of perimeter contours, all types and sizes of which must be covered. Junction boxes are commercially available in square, rectangular, hexagonal and circular shapes. For purposes of illustration and concise discussion, this specification will refer principally to the most common duplex electrical outlet assembly which is rectangular in shape. It should be clearly understood that the invention is not limited to this embodiment.

Referring now to the drawings, FIG. 1 is a front plan view of a preferred embodiment of the protective safety enclosure 10 for a duplex electrical outlet assembly with two covering shields missing, as will be explained hereinafter. Enclosure 10 is designed both to cover an unused socket and also to enclose securely male plugs, so that children may not touch the sockets or tamper with plugs inserted in said sockets.

As shown in FIGS. 1 and 2, enclosure 10 is a hollow, box-like or shell-like three dimensional structure with one major open face contoured to fit snugly around and enclose the perimeter of a junction box, or the structural member cut-out in which the junction box is mounted, if applicable. Enclosure 10 has a major front wall 12 which is relatively flat and at least one perimeter wall 14 integrally formed with front wall 12. In the embodiment of FIG. 1, enclosure 10 has four perimeter walls 14. These features are shown in cross-section in FIG. 2. In the embodiment of FIG. 6, enclosure 60 has one perimeter wall 64. The precise configuration of enclosure 10 is a matter of functional and aesthetic design. In FIG. 1, perimeter walls 14 are shown sloping rearward. The depth of enclosure 10 is the distance from front wall 12 to the edges of the perimeter wall of a junction box to be covered. The conventional electrical outlet assembly has the plug receiving surface of its sockets on a plane slightly forward of the edges of the perimeter wall of its junction box so that these surfaces are flush with the surface of a conventional cover plate. Preferably, protective enclosure 10 replaces the conventional cover plate. The specific depth of any model of enclosure 10 is a function of the size of the plug to be enclosed and the relative location of the surface of the plug receiving socket within the junction box. The front wall of enclosure 10 should be just beyond the forward edge of the plug so that the plug cannot be withdrawn. Since plugs, outlets and junction boxes are available in few standard sizes, only a few variations in the width, height and depth of enclosure 10 are necessary to accommodate most commercially available parts.

FIG. 1 shows enclosure 10 having two apertures or openings 16, 18 on its front panel 12, each approximately equivalent in size to the front face of a socket. Apertures 16, 18 are in registration with but spaced apart from female sockets or receptacles 20, 22 in an outlet assembly. As shown in FIG. 2, a plug 38 may be inserted through an aperture 18 to be inserted into socket 22. FIG. 1 also shows a plurality of small holes 32 about the periphery of apertures 16, 18, whose function will be described hereinafter.

The safety feature of the invention derives from the use of two types of protective shields to cover apertures 16, 18 of enclosure 10. FIG. 3 is a front plan view of a first protective shield 24, which is a solid planar piece of the same material as that of enclosure 10, being dimensioned slightly larger than the aperture it is designed to cover, and having a plurality of tapered prongs 30 extending inward on one side thereof and disposed around its periphery corresponding in pattern to the holes 32 disposed about apertures 16, 18. Tapered prongs 30 are designed to be received in a snap-fitting arrangement within holes 32 such that a first covering shield 24 will snugly close an aperture 16 and prevent access thereto by a small child. First covering shield 24 is for a socket 20 which is not in use. When it becomes necessary to use a socket, first covering shield 24 may be removed by prying it off with a screwdriver or similar blade and said shield 24 may be saved for reuse at a later time.

The second type of protective shield 25 has two cooperating members 26, 28, each of which is similar to and exactly the same size as one half of shield 24, with the exception of an aperture 34, which is centrally disposed when said halves 26, 28 are juxtaposed in complementary registration, as shown in FIG. 4. One half of aperture 34 is cut away from member or half shield 26 and the other half is cut away from member or half shield 28. When the complementary members 26, 28 are in registration, the total area of aperture 34 is approximately equal to the cross-sectional area of a line cord 36 connected at one end to a plug 38, as shown in FIG. 2, such that a line cord 36 is snugly gripped by cooperating half shields 26, 28. Each half shield 26, 28 has a plurality of tapered prongs 30 about its periphery, the total number of prongs on the two cooperating members 26, 28 being the same as the number on first shield 24, so that the prongs of half shields 26, 28 may be received into the same holes 32 on front panel 12.

Second covering shield 25 is simple to use, as should be obvious from FIG. 2. After a plug 38 attached to one end of a line cord 36 is inserted into socket 22 through aperture 18, one half shield 28 is snap-fitted into position on front panel 12 by forcing tapered prongs 30 into corresponding holes 32 and the line cord 36 is positioned in the first half of aperture 34. At this point plug 38 is fully enclosed in enclosure 10, preferably with its outer end in close proximity to front panel 12. The second half shield 26 is then snap-fitted into position while maintaining the position of line cord 36 in aperture 34. Since plug 38 fits tightly within enclosure 10 and line cord 36 is gripped by cooperating members 26, 28, it is very difficult for an infant or small child to play with or remove plug 38 from socket 22.

Protective enclosure 10 is secured to an electrical outlet assembly in a conventional manner, using an elongated screw or bolt 40 which passes through a central bore 42 to guide screw 40 to a conventional threaded opening or nut in the outlet assembly. Depending on the configuration of the outlet assembly one or more attachment screws and bores may be required and the bores might not be centrally located.

FIG. 6 illustrates an embodiment of the invention designed to fit over electrical outlet assemblies in which the junction box is cylindrical in shape. For this embodiment enclosure 10 is a shell-like structure, a segment of a hemisphere or a truncated hemisphere. Enclosure 60 has a flat front wall 62, a single sloping side wall 64 and the edges of its open face have a circular contour. In the Figure enclosure 60 is shown with only one socket, an aperture 66 identical in size and shape to the aperture 16 in FIG. 1, and holes 32 around its periphery. Both types of covering shields 24, 25 may be utilized with enclosure 60 of FIG. 6.

Figure 7:
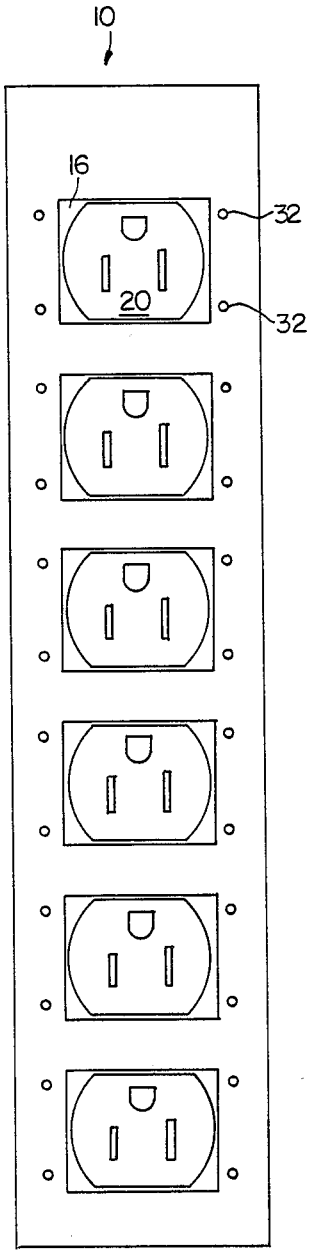
FIG. 7 is a front plan view of a third embodiment of the enclosure of the present invention designed to cover an extended array of sockets in an electrical outlet assembly.

FIG. 7 illustrates still another embodiment of enclosure 10, this being a linear array of six sockets in one junction box or power strip. It can be readily seen that enclosure 10 of FIG. 7 differs from enclosure 10 of FIG. 1 only in its dimensions, the number of apertures 16 and the number of covering shields 24, 25 required for its closure.

Protective safety enclosure 10 should be formed of a strong, lightweight insulating material having sufficient strength and rigidity to resist the tugging and pulling forces of an infant or small child. In all embodiments, sidewalls 14 are integrally formed with front wall !2 and each other. In all embodiments, the sidewalls have integral edges which define a contour somewhat larger than the contour to be covered and parallel thereto.

I claim:

1. A protective safety enclosure for an electrical outlet assembly having at least one plug receiving socket, comprising:

a hollow three-dimensional structure having a relatively flat front panel, at least one side wall extending completely around the perimeter of said front panel, said side wall extending rearwardly from said front panel, wherein said sidewall has an integral edges defining a perimeter shape somewhat larger than said outlet assembly to be enclosed, and an open face opposite said front panel and defined by said edge;

said enclosure having a depth defined by said side wall dimensioned to snugly enclose a male plug received in one of said sockets;

said front panel having one aperture for each socket within said electrical outlet assembly, each said aperture being in registration with one of said sockets and being dimensioned to permit the passage therethrough of a male plug with line cord attached;

first shield means for detachably covering and uncovering each of said apertures on said front panel when said corresponding socket is not in use;

said first shield means comprising a thin planar cover dimensioned to fit over each of said apertures in said front panel, said cover being slightly larger in size than said apertures; and means to removably attach said cover to said front panel such that when said cover is attached to said front panel, it is supported by said front panel, thereby preventing any access to a socket within said enclosure;

second shield means for detachably covering each of said apertures on said front panel when a plug connected to one end of a line cord in received in said corresponding socket;

said second shield means comprising a thin planar cover divided into two equal-sized cooperating members, said cooperating members together being dimensioned to fit over each of said apertures in said front panel;

a centrally disposed aperture in said two-member panel, such that one half of said aperture is cut out from each of said members and said complementary halves are positioned opposite each other to form a single aperture equal in size to the cross-section of a line cord; and means to removably attach each member of said second shield sequentially to said front panel such that when said two members are attached to said front panel, said second shield is supported by said front panel and said two members are enabled to grip a line cord passing through said aperture in said second shield;

a plurality of small holes disposed around the periphery of each aperture in said front panel;

a plurality of tapered prongs disposed about the periphery of said first shield and each member of said second shield at positions complementary to said holes around the periphery of each of said front panel apertures such that said tapered prongs of said shield may be force fitted into said holes about said aperture to cover said aperture; and means to secure said enclosure to an electrical outlet assembly.

2. The enclosure of claim 1 wherein said enclosure is a five-sided box and has four sidewalls.

3. The enclosure of claim 1 wherein said enclosure is hemispherical in shape, is truncated to provide a flattened front surface and has one sidewall.

* * * * *